US008180264B2

(12) United States Patent
Hasegawa et al.

(10) Patent No.: US 8,180,264 B2
(45) Date of Patent: May 15, 2012

(54) IMAGE FORMING UNIT AND IMAGE FORMING APPARATUS

(75) Inventors: Kentaro Hasegawa, Tokyo (JP); Takuya Goto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 584 days.

(21) Appl. No.: 12/351,066

(22) Filed: Jan. 9, 2009

(65) Prior Publication Data

US 2009/0180815 A1 Jul. 16, 2009

(30) Foreign Application Priority Data

Jan. 11, 2008 (JP) ..... 2008-004779

(51) Int. Cl.
*G03G 15/08* (2006.01)

(52) U.S. Cl. ..... 399/281; 399/119

(58) Field of Classification Search ..... 399/281, 399/358–360, 119, 254, 255
See application file for complete search history.

(56) References Cited

U.S. PATENT DOCUMENTS 5,956,556 A * 9/1999 Nakajima et al. ..... 399/359
7,099,612 B2 * 8/2006 Choi et al. ..... 399/281

FOREIGN PATENT DOCUMENTS

| | | | |
|---|---|---|---|
| JP | 2-29671 | A | 1/1990 |
| JP | 11015230 | A | 1/1999 |
| JP | 11073078 | A | 3/1999 |
| JP | 11-249402 | A | 9/1999 |
| JP | 2006-047470 | A | 2/2006 |

* cited by examiner

*Primary Examiner* — Hoang Ngo
(74) *Attorney, Agent, or Firm* — Panitch Schwarze Belisario & Nadel LLP

(57) ABSTRACT

An image forming unit and an image forming apparatus comprising the image forming unit are supplied capable of preventing toner in bottom part of toner accommodating room from accumulating so as to obtain toner image with good quality. In the image forming unit, a developer accommodating section that accommodates developer; a developing member that supplies developer to an electrostatic latent image on an image carrying body; a supplying member that faces to the developing member and supplies developer to the developing member; and a conveying mechanism that conveys developer in bottom part of the developer accommodating section to the upper part of the developer accommodating section.

9 Claims, 10 Drawing Sheets

IMAGE FORMING UNIT AND IMAGE FORMING APPARATUS

FIELD OF THE INVENTION

The invention relates to an image forming unit to supply toner to electrostatic latent image formed on image carrying body and form a developed image; and relates to an image forming apparatus which has the image forming unit.

BACKGROUND OF THE INVENTION

In the past, image forming unit in an image forming apparatus such as electronic photography printer and the like, as disclosed in Patent Document 1 stated below, is composed of a toner cartridge which has a stirring member for stirring toner being filled in; a toner accommodating room to accommodate toner supplied from the toner cartridge; a supplying roller; a developing roller; a developing blade; a photosensitive drum; a charging roller; a exposing unit and the like. Here, the developing roller is furnished as contacting with and pressing the supplying roller. Further, the developing blade is furnished as contacting with the surface of the developing roller.

Patent Document 1: Japan patent publication of No. 2006-047470.

In the image forming unit, the stirring member is used for preventing grittiness of toner image caused by unevenness of granular distribution of toner filled in the toner cartridge; and for keeping fluidity so that toner does not solidify.

Then, through a control of a controlling section of the image forming apparatus, when the surface of the photosensitive drum is charged by using the charging roller, the exposing unit exposes print area on the basis of image data stored in memory. Thereby, on the surface of the photosensitive drum, an electrostatic latent image is formed which has an exposed exposure area where surface electric potential has lost by discharging electricity and a non-exposure area in charging state.

After the electrostatic latent image is formed on the surface of the photosensitive drum, through a control of the controlling section, toner being accommodated in the toner accommodating room and approaching the supplying roller adheres to the surface of the supplying roller. Then, the toner adhering to the surface of the supplying roller is pressed on a pressing and contacting area with the developing roller, takes a charge due to friction, and electrically adheres to the surface of the developing roller through Coulomb force of electric charge. The toner adhering to the surface of the developing roller, after passed the blade, becomes thin layer through a pressing and contacting force of the developing blade to regulate thickness of toner layer.

On the developing roller, a direct current voltage called developing bias is provided, the exposure area of the image forming unit formed on the photosensitive drum has lost surface electric potential. Therefore, an electric potential difference is generated between the surface of the developing roller and the exposure area of the electrostatic latent image formed on the surface of the photosensitive drum. By the electric potential difference, the toner adhering to the surface of the developing roller moves to the exposure area of the electrostatic latent image on the surface of the photosensitive drum.

After the toner moved to the exposure area of the electrostatic latent image on the surface of the photosensitive drum, a toner image is formed on the surface of the photosensitive drum as an visible image. Then, the toner image formed on the surface of the photosensitive drum is transferred onto print medium which is conveyed and is pressed on the photosensitive drum, by a transferring roller which is furnished to press and contact with the photosensitive drum.

In the image forming unit, a part of the toner that gets pressure from the supplying roller and the developing roller and is supplied to the surface of the developing roller, as development remainder toner, is not supplied to the surface of the photosensitive drum but is remaining on the surface of the developing roller. The development remainder toner is removed by pressure of the supplying roller in the pressing and contacting area of the developing roller and the supplying roller, and is accommodated to the toner accommodating room, then is used again in developing process.

However, in such image forming unit, it is impossible to obtain toner image with good quality, so that image quality becomes worse.

SUMMARY OF THE INVENTION

It is, therefore, an object of the invention to provide an image forming apparatus capable of solving the above problem, so as to improve image quality.

An aspect of the invention is to provide an image forming unit, comprising a developer accommodating section that accommodates developer; a developing member that supplies developer to an electrostatic latent image on an image carrying body; a supplying member that faces to the developing member and supplies developer to the developing member; and a conveying mechanism that conveys developer in bottom part of the developer accommodating section to the upper part of the developer accommodating section.

Another aspect of the invention is to provide an image forming apparatus comprising at least one image forming unit, wherein the image forming unit includes a developer accommodating section that accommodates developer; a developing member that supplies developer to an electrostatic latent image on an image carrying body; a supplying member that faces to the developing member and supplies developer to the developing member; and a conveying mechanism that conveys developer in bottom part of the developer accommodating section to the upper part of the developer accommodating section.

THE EFFECT OF THE PRESENT INVENTION

According to the invention, because the conveying mechanism conveys developer from bottom of the developer accommodating section to upside of the developer accommodating section, it is possible to prevent developer from remaining on the bottom of the developer accommodating section. As a result, it is possible to improve image quality.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

<Structure of Embodiment 1>

Figure 4:
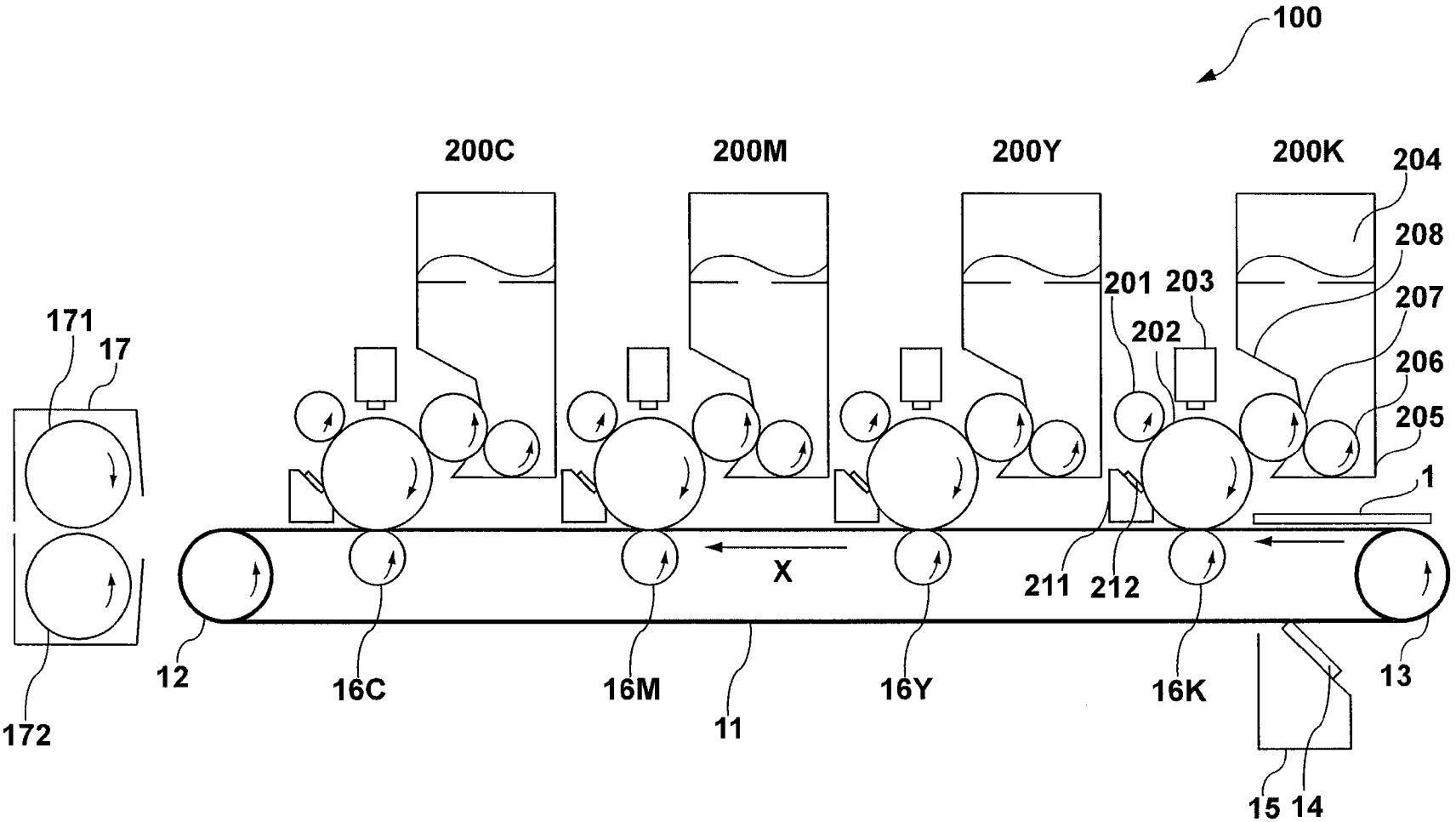
FIG. 4 is a diagram showing a structure of image forming apparatus in embodiment 1 of the present invention.

FIG. 4 is a diagram showing a structure of image forming apparatus in embodiment 1 of the present invention.

An image forming apparatus 100 of the embodiment 1 of the present invention, as shown by FIG. 4, comprises image forming units 200K, 200Y, 200M, 200C; a transfer belt 11; a driving roller 12; a driven roller 13; a transfer belt use cleaning blade 14; a transfer belt waste toner accommodating section 15; transferring rollers 16K, 16Y, 16M, 16C; and an image fixing unit 17.

The image forming apparatus 100 is connected with an upper apparatus (not shown) such as PC (Personal Computer) or the like, via network. In the image forming apparatus 100, a controlling section (not shown) formed from micro computer performs control of whole apparatus to control voltage supply of power source section (not shown) toward respective section; drives of respective motors (not shown) for rotating respective rollers; and print based on information outputted from respective sensors.

Figure 1:
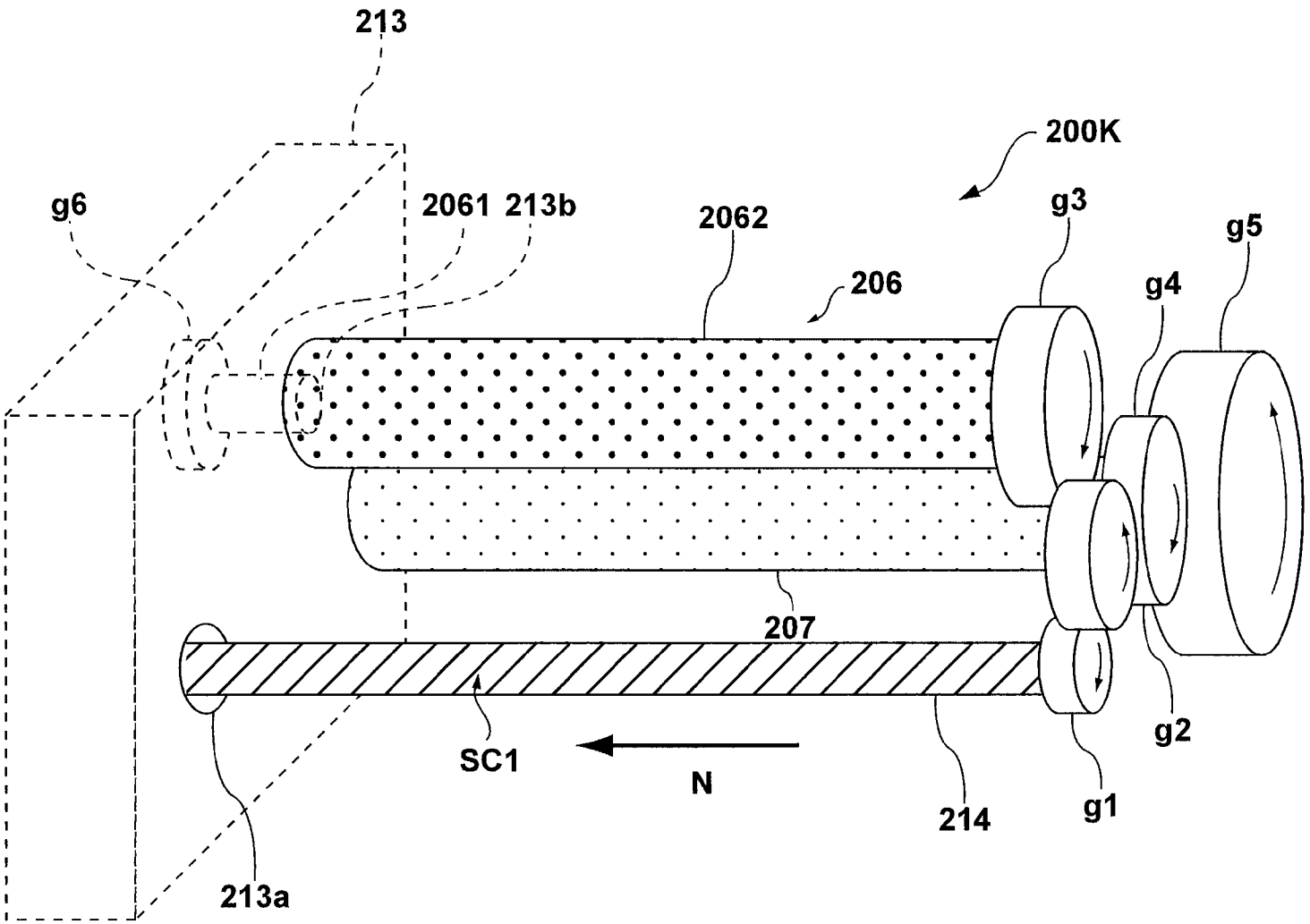
FIG. 1 is a first cubic diagram showing a structure of image forming unit in embodiment 1 of the present invention.
Figure 2:
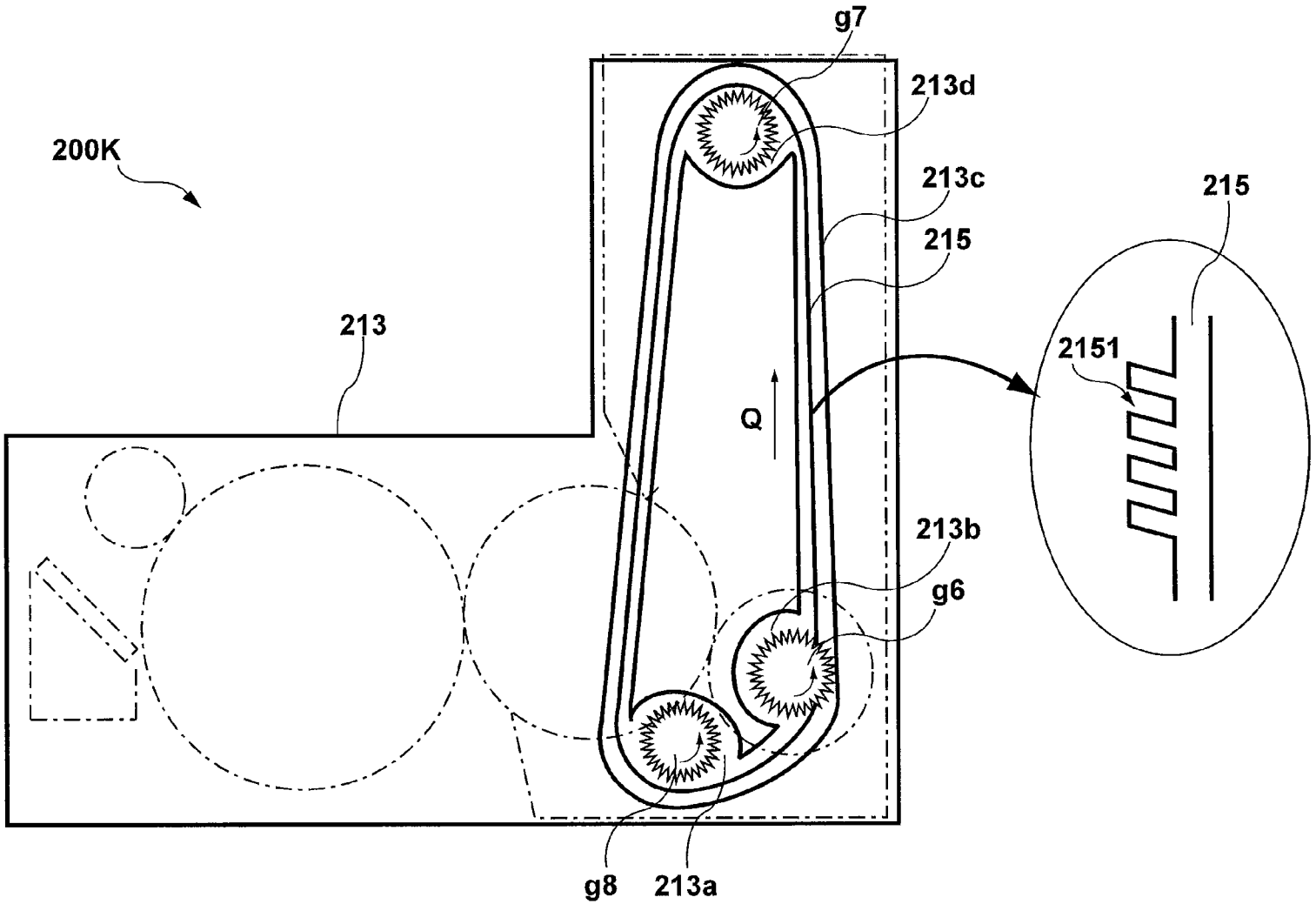
FIG. 2 is a first diagram showing a structure of image forming unit in embodiment 1 of the present invention.
Figure 3:
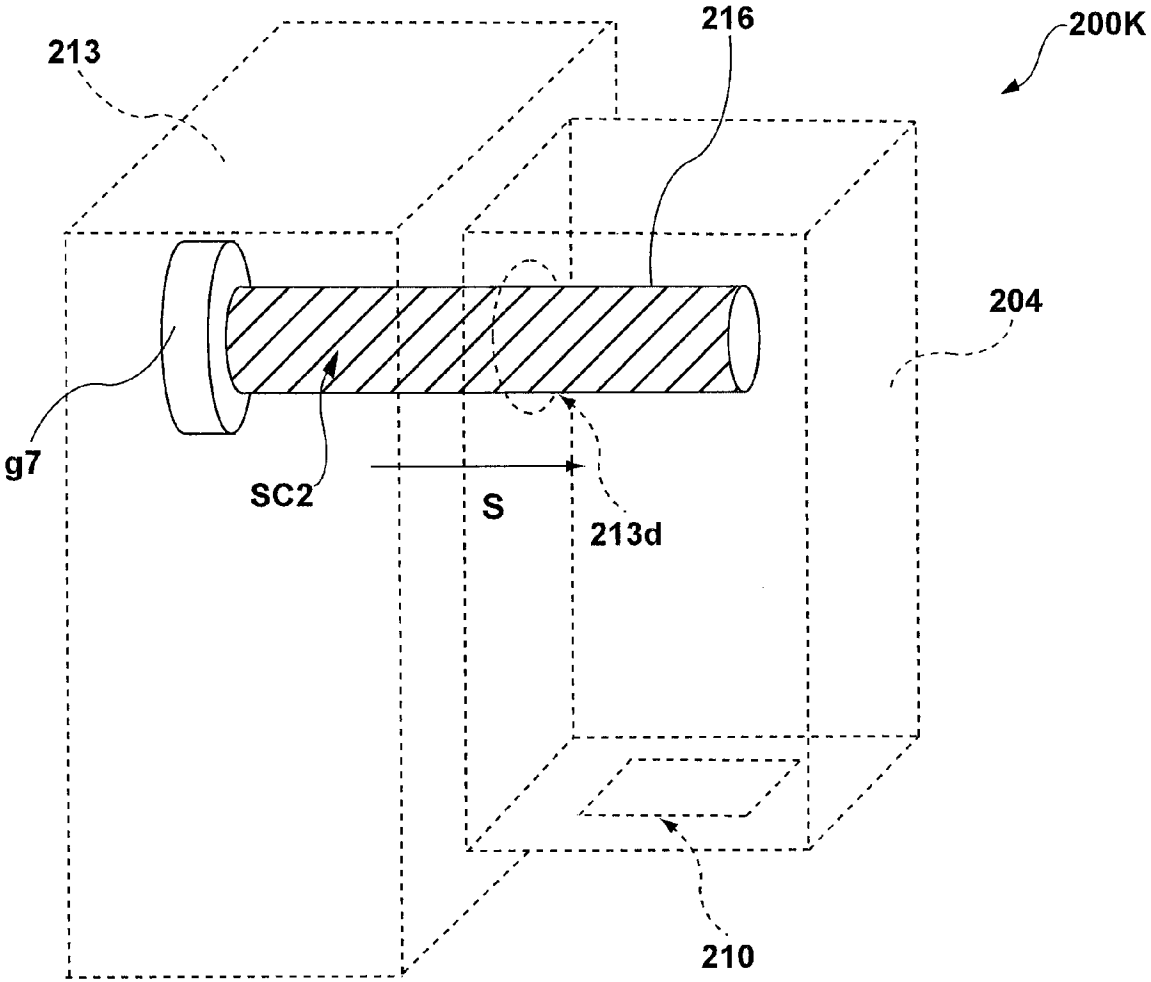
FIG. 3 is a second cubic diagram showing a structure of image forming unit in embodiment 1 of the present invention.

FIG. 1 is a first cubic diagram showing a structure of image forming unit in embodiment 1 of the present invention; FIG. 3 is a second cubic diagram showing a structure of image forming unit in embodiment 1 of the present invention; FIG. 2 is a first diagram showing a structure of image forming unit in embodiment 1 of the present invention; and FIG. 5 is a second diagram showing a structure of image forming unit in embodiment 1 of the present invention.

Figure 5:
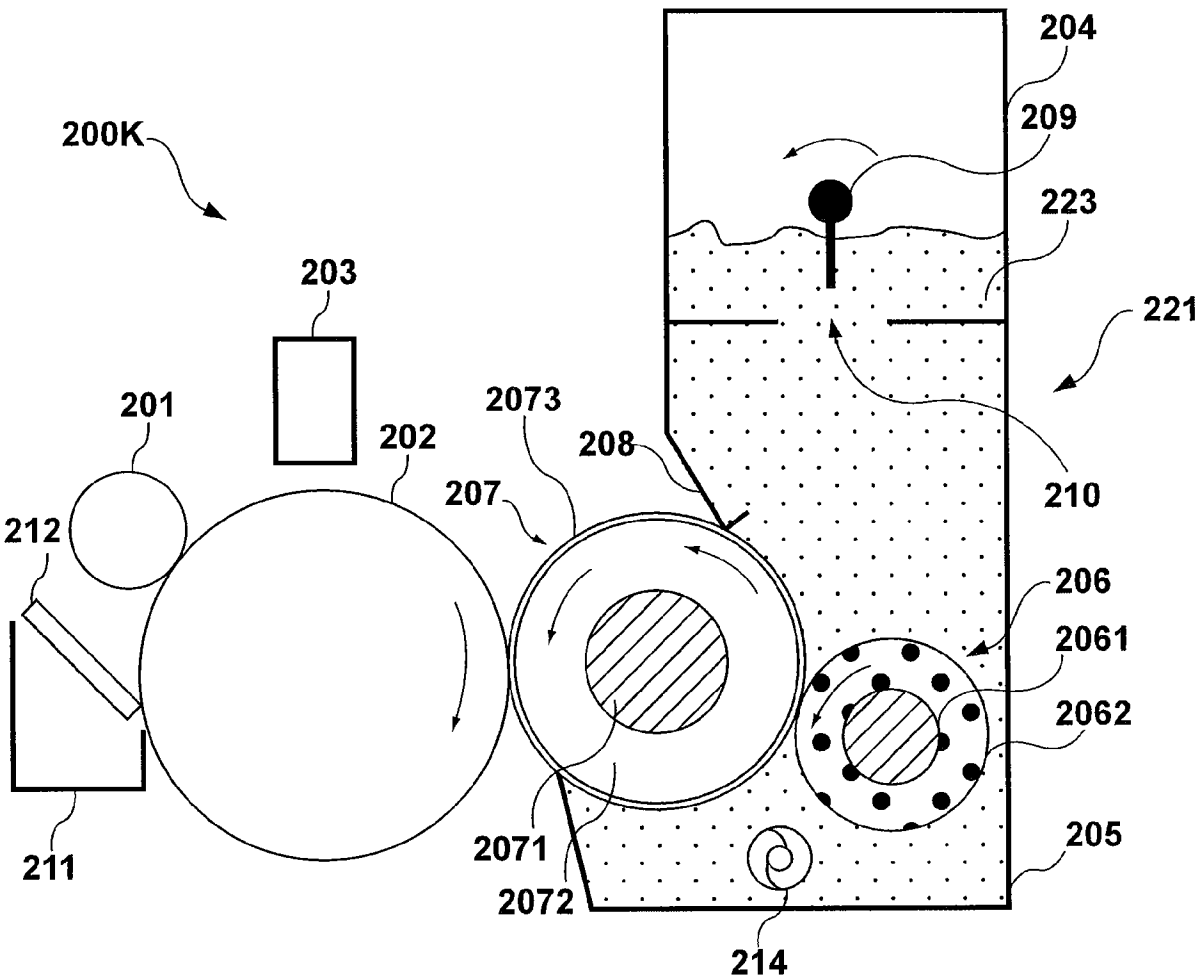
FIG. 5 is a second diagram showing a structure of image forming unit in embodiment 1 of the present invention.

The image forming unit 200K is a mechanism to form toner of black (K) color; as shown by FIGS. 4 and 5, includes a charging roller 201, a photosensitive drum 202, an exposing unit 203, a toner cartridge 204, a toner accommodating room 205, a supplying roller 206, a developing roller 207, a layer formation blade 208, a stirring member 209, an opening part 210, a transfer remainder toner accommodating section 211, and a cleaning blade 212.

Here, the toner accommodating room 205, the supplying roller 206, the developing roller 207, the layer formation blade 208 constitutes a developing unit to perform developing process. The image forming unit 200K keeps toner of black color in the toner cartridge 204, and uses the toner accommodating room 205 to accommodate toner supplied from the toner cartridge 204. In the image forming unit 200K, as shown by FIG. 5, the toner cartridge 204 and the toner accommodating room 205 are separated by the opening part 210, however, instead of such structure, it is possible to form a toner accommodating section by unifying a toner cartridge and a toner accommodating room without using opening part to separate.

That is, in the embodiment, as shown by FIG. 5, as a developer accommodating section, a toner accommodating section 221 is composed of the toner cartridge 204 containing a toner accommodating part 223 and the toner accommodating room 205. However, it is possible to form the toner accommodating section 221 by unifying the toner accommodating part 223 and the toner accommodating room 205.

The image forming unit 200Y is a mechanism to form toner of yellow (Y) color, except that the toner cartridge 204 keeps toner of yellow color, other components are the same as that in the image forming unit 200K.

The image forming unit 200M is a mechanism to form toner of magenta (M) color, except that the toner cartridge 204 keeps toner of magenta color, other components are the same as that in the image forming unit 200K.

The image forming unit 200C is a mechanism to form toner of cyan (C) color, except that the toner cartridge 204 keeps toner of cyan color, other components are the same as that in the image forming unit 200K.

Every toner of respective colors kept in the toner cartridges 204 of the image forming units 200K, 200Y, 200M, 200C, is formed by polyester serving as combining resin and by coloring agent. In the toner, external additive agent (silica) with charging characteristic is added for controlling fluidity and changing performance. Therefore, the toner is a developer having a volume average particle diameter of 5.8 μm.

As coloring agent of toner of black color, carbon black may be used; as coloring agent of toner of yellow color, pigment of Quinacridone series (C. I. Pigment Yellow 185) may be used; as coloring agent of toner of magenta color, pigment of Quinacridone series (C. I. Pigment Red 122) may be used; as coloring agent of toner of cyan color, pigment of copper Phthalocyanine (C. I. Pigment Blue 15) may be used.

The image fixing unit 17 is a mechanism to fix toner image onto print medium 1; as shown by FIG. 4, is composed of a heating roller 171 and a pressing roller 172. Here, the heating roller 171 has roller body and a heater (not shown) inside the roller body for heating the roller body.

On the one hand, when the image forming apparatus 100 received a print instruction and image data from upper apparatus connected with the image forming apparatus 100 via network, via an I/F (interface) section (not shown), the image data is stored into an image memory (not shown) by a control of a controlling section (not shown) of the image forming apparatus 100. Here, the I/F section is a communicating section to perform notifications of a receiving of the image data and a process result of the received image data; also is a serial interface such as USB (Universal Serial Bus) and the like, or a parallel interface such as IEEE1284 and the like; and is connected with the upper apparatus in a predetermined protocol.

On the other hand, after user puts manuscript onto a reading section (not shown) of the image forming apparatus 100 and instructs a print by using buttons in an inputting section (not shown), the reading section generates image data according to the manuscript, the generated image data is stored into an image memory (not shown) through a control of a controlling section (not shown).

After the image data is stored in the image memory, through a control of the controlling section (not shown), a paper feeding roller (not shown) rotates to feed the print medium 1 kept in paper tray (not shown) in most upper position.

While the paper feeding roller feeds the print medium 1, through a control of controlling section (not shown), a conveying roller (not shown) rotates. Thereby, the print medium 1 is sandwiched to be conveyed by the conveying roller and a pressing roller (not shown) which is furnished to face to the conveying roller.

When the front edge of the print medium 1 which is sandwiched to be conveyed by the conveying roller and the a pressing roller arrives at a passage sensor (not shown), through a control of controlling section (not shown), the respective photosensitive drums 202 and the respective driving rollers 12 of the image forming units 200K, 200Y, 200M, 200C rotate.

When the photosensitive drum 202 of the image forming unit 200K rotates, through a control of controlling section (not shown), the charging roller 201 charges the surface of the photosensitive drum 202.

After the surface of the photosensitive drum 202 is charged, the exposing unit 203 formed from a LED (Light Emitting Diode) array obtained by arranging LED, emits light through a control of controlling section (not shown) so as to form an electrostatic latent image onto the surface of the photosensitive drum 202 having been charged on the basis of the image data kept in the image memory.

After the electrostatic latent image is formed on the surface of the photosensitive drum 202, the toner of black color in the toner cartridge 204 is supplied to the surface of the developing roller 207 via the supplying roller 206 through a control of controlling section (not shown).

The supplying roller 206, as shown by FIG. 5, is composed of a metal shaft 2061 with a diameter of 6 mm, and a foaming body 2062 which is made from Urethane rubber with a thickness of 5 mm and a rubber hardness of 50° (ASKER-F) and is formed on the metal shaft 2061 by a coating process.

The developing roller 207, as shown by FIG. 5, is composed of a metal shaft 2071 with a diameter of 14 mm; an elastic body 2072 which is made from silicon rubber with a thickness of 6 mm, a rubber hardness of 40° (ASKER-C), and an electro-conductivity of resistance value of $10^4$ Ω·cm and which is formed on the metal shaft 2071 by a coating process; and a coat layer 2073 which is an insulating layer made from acryl resin with a thickness of 5 μm and a relative permittivity of "4", and which is formed on the elastic body 2072 by a coating process.

The layer formation blade 208 is used for regulating layer thickness of toner on the developing roller 207 to uniform it. After the toner on the surface of the developing roller 207 passed the layer formation blade 208, through a shearing force of the layer formation blade 208, the toner layer thickness is regulated to become uniform.

The layer formation blade 208, as shown by FIG. 5, is formed from a SUS304 board spring which has a thickness of 80 μm, a free length of about 12.5 mm and a shape of "R" formed by bending process; and is furnished as contacting with the developing roller 207.

When the surface of the developing roller 207 on which toner whose layer thickness is regulated to be uniform is adhering contacts with the surface of the photosensitive drum 202, the toner is developed onto the electrostatic latent image on the photosensitive drum 202. Thereby, on the surface of the photosensitive drum 202, a toner image of black color is formed to correspond to the electrostatic latent image, as a visible image.

Likewise, through image forming processes in the image forming units 200Y, 200M, 200C, on the surfaces of the respective photosensitive drums 202 in the image forming units 200Y, 200M, 200C, respective toner images of yellow, magenta, cyan colors are formed to correspond to the respective electrostatic latent images, as visible images.

Further, when the driving roller 12 rotates, the transfer belt 11 formed from endless belt which is wrapped and is extended around the driving roller 12 and the driven roller 13, as shown by FIG. 4, moves along a direction of "X". Then, the print medium 1 is conveyed by the transfer belt 11, and is sandwiched by the photosensitive drum 202 and the transferring roller 16K to be further conveyed. Thereby, toner image on the surface of the photosensitive drum 202 is transferred onto the print medium 1 by the transferring roller 16K on which high voltage outputted from a power source (not shown) is provided, through a control of controlling section (not shown).

After the toner image on the surface of the photosensitive drum 202 is transferred to the print medium 1, the toner remaining on the surface of the photosensitive drum 202, as transfer remainder toner, is removed by the cleaning blade 212.

Likewise, toner images of respective colors formed in the image forming units 200Y, 200M, 200C, through a control of controlling section (not shown), are respectively transferred onto the print medium 1 by the transferring rollers 16Y, 16M, 16C on each high voltage outputted from a power source (not shown) is provided. Then, likewise, transfer remainder toners remaining on respective surfaces of the photosensitive drums 202 in the image forming units 200Y, 200M, 200C are removed by the respective cleaning blades 212 in the image forming units 200Y, 200M, 200C.

On the one hand, at that time that toner image on the surface of the photosensitive drum 202 is transferred onto the print medium 1, through a control of controlling section (not shown), the surface of the heating roller 171 is heated to a predetermined temperature by a heater (not shown) furnished inside the heating roller 171. Here, the heater is supplied with a high voltage outputted from a power source (not shown) via a high voltage controlling section (not shown) so as to heat, through a control of controlling section (not shown).

Then, when the print medium 1 on which respective toner images of respective colors are transferred is sandwiched to be conveyed by the heating roller 171 and the pressing roller 172 furnished as facing to the heating roller 171, the toner images on the print medium 1 are heated and are pressed by the heating roller 171 and the pressing roller 172, and are fixed on the print medium 1.

The print medium 1 which is performed a fixation process by the heating roller 171 and the pressing roller 172 is sandwiched to be conveyed by an ejecting roller (not shown) and a pressing roller (not shown) furnished as facing to the ejecting roller, and is ejected from an ejection opening (not shown) of the image forming apparatus 100. Thus, a print process of a sheet of print medium 1 is ended in the image forming apparatus 100.

On the other hand, when toner image on the surface of the photosensitive drum 202 is transferred onto the print medium 1, in the case that the toner image is transferred out of the print medium 1, toner adheres to the transfer belt 11. Then, the toner adhering to the transfer belt 11 is removed by the transfer belt use cleaning blade 14 furnished near to the driven roller 13 shown by FIG. 4 as contacting with the transfer belt 11; and is collected by the transfer belt waste toner accommodating section 15 as waste toner.

Further, on the one hand, the cleaning blade 212, as shown by FIG. 4, is used for removing the transfer remainder toner remaining on the surface of the photosensitive drum 202. The cleaning blade 212 is furnished so that its one edge contacts with the surface of the photosensitive drum 202. After the toner on the surface of the photosensitive drum 202 is transferred onto the print medium 1, the transfer remainder toner remaining on the surface of the photosensitive drum 202 is removed by a contact force of the cleaning blade 212 contacting with the photosensitive drum 202.

The transfer remainder toner removed by the cleaning blade 212, as shown by FIG. 4, is collected in the transfer remainder toner accommodating section 211. The transfer remainder toner collected in the transfer remainder toner accommodating section 211 is conveyed to a waste toner accommodating room (not shown) in the toner cartridge 204 through a transfer remainder toner conveying means (not shown) in each image forming unit; and is accommodated in the waste toner accommodating room as waste toner. Then, the waste toner accommodated in the waste toner accommodating room is withdrawn together with the toner cartridge 204 when exchanging the toner cartridge 204. Here, in the case that image forming unit is the image forming unit 200K, it is possible to convey the transfer remainder toner of black color accommodated in the transfer remainder toner accommodating section 211 to the toner cartridge 204 through a transfer remainder toner conveying means (not shown) in the image forming unit 200K; and make the transfer remainder toner disperse in toner kept in the toner cartridge 204 so as to use the transfer remainder toner again for developing process.

On the other hand, the development remainder toner that is a part of toner supplied to the surface of the developing roller 207 but is remaining on the surface of the developing roller 207 without being supplied to the surface of the photosensitive drum 202 because of the pressure of the supplying roller 206 and the developing roller 207, is removed from a contact area of the supplying roller 206 and the developing roller 207 by a pressure of the supplying roller 206; and is accommodated to the toner accommodating room 205. The accommodated development remainder toner accumulates on the bottom of the toner accommodating room 205 under positions where the supplying roller 206 and developing roller 207 are furnished.

The following is to explain main part of the present invention in detail.

The respective image forming units 200K, 200Y, 200M, 200C, as shown by FIG. 1, further comprises a conveyance use side wall 213 that is one side wall of image forming unit; a first developer conveying member 214 that is furnished under the supplying roller 206; a second developer conveying member 215 (refer to FIG. 2); and a third developer conveying member 216 (refer to FIG. 3).

The first developer conveying member 214, the second developer conveying member 215 and the third developer conveying member 216 constitute a conveying mechanism.

On the conveyance use side wall 213, as shown by FIG. 1, an opening hole 213*a* used for letting one end of the first developer conveying member 214 pass through, and an opening hole 213*b* used for letting one end of the metal shaft 2061 of the supplying roller 206 pass through, are manufactured; as shown by FIG. 2, a belt concave portion 213*c* used for guiding the second developer conveying member 215, is manufactured; as shown by FIG. 3, an opening hole 213*d* used for letting one end of the third developer conveying member 216 pass through, is manufactured. In the conveyance use side wall 213, the opening hole 213*a*, the opening hole 213*b*, the belt concave portion 213*c* and the opening hole 213*d* are coupled.

Further, as shown by FIG. 1, because the opening hole 213*b* on the conveyance use side wall 213 only allows the one end of the inside metal shaft 2061 of the supplying roller 206 to pass through and the outside foaming body 2062 is furnished as contacting with the conveyance use side wall 213 around the opening hole 213*b*, toner kept in the toner accommodating room 205 does not leak from the opening hole 213*b*.

The first developer conveying member 214, as shown by FIG. 5, is furnished on the bottom part of the toner accommodating room 205 as locate under the supplying roller 206 and the developing roller 207; and is used for conveying toner containing the development remainder toner accumulating on the bottom part to the opening hole 213*a* manufactured on the conveyance use side wall 213. The first developer conveying member 214 has a screw portion SC1 shown by FIG. 1. When the first developer conveying member 214 rotates according to a structure described below, the toner with a high density of the development remainder toner accumulating in the bottom part of the toner accommodating room 205 is conveyed to the opening hole 213*a* of the conveyance use side wall 213.

On other end of the first developer conveying member 214, as shown by FIG. 1, a gear g1 is furnished as rotation transfer member; on other end of the developing roller 207, as shown by FIG. 1, a gear g4 is furnished as rotation transfer member; the gear g1 engages with the gear g4 via an idle gear g2. As shown by FIG. 1, on other end of the supplying roller 206, a gear g3 is furnished.

Then, as shown by FIG. 1, on other end of the photosensitive drum 202, a gear g5 is furnished, the gear g4 engages with the gear g5. Because the gear g5 is driven by a driving motor (not shown), the first developer conveying member 214 starts to rotate on the basis of rotation of respective rollers stated above, so as to convey the toner with high density of the development remainder toner in the bottom part of the toner accommodating room 205, along a direction of "N" shown by FIG. 1, through the screw portion SC1. As shown by FIG. 1, because the one end of the first developer conveying member 214 is inserted into the opening hole 213*a* manufactured on the conveyance use side wall 213, the toner is conveyed to the opening hole 213*a*.

The second developer conveying member 215, as shown by FIG. 2, is an endless belt; is used for conveying the toner in the opening hole 213*a* locating on the underside of the conveyance use side wall 213 toward the opening hole 213*d* locating on the upside of the conveyance use side wall 213; and is furnished inside the belt concave portion 213*c*. In the second developer conveying member 215, as shown by FIG. 2, ditch 2151 is formed on the inside of the endless belt, the ditch 2151 engages with respective gears described below, the ditch 2151 also is used for carrying the toner.

Then, the second developer conveying member 215, as shown by FIG. 2, is furnished in the belt concave portion 213*c* as being extended by gear g6, gear g7 and gear g8 that are used to transfer rotation drive.

The gear g6, as shown by FIG. 1, is furnished on the one end of the metal shaft 2061 on the inside of the supplying roller 206 which projects from the opening hole 213*b* of the conveyance use side wall 213; and as shown by FIG. 2, engages with the plural ditches 2151 on the inside of the second developer conveying member 215.

The gear g7, as shown by FIG. 2, is furnished on the one end of the third developer conveying member 216 and engages with the plural ditches 2151 on the inside of the second developer conveying member 215.

The gear g8 is furnished on the one end of the first developer conveying member 214; is fixed on the inner part of the opening hole 213*a* of the conveyance use side wall 213 via a bearing; and engages with the plural ditches 2151 on the inside of the second developer conveying member 215.

According to the above stated structure, the second developer conveying member 215, as shown by FIG. 2, uses the respective ditches 2151 to carry toner conveyed to the opening hole 213*a* of the conveyance use side wall 213 and moves upward along a direction of "Q", on the basis of the rotation of the supplying roller 206.

Then, when the ditch 2151 moves near to the gear g7 so as to move downward, the toner carried and conveyed by the ditch 2151 of the second developer conveying member 215 drops from the ditch 2151. The toner having dropped from the ditch 2151, as shown by FIG. 2, accumulates in the opening hole 213*d* of the conveyance use side wall 213.

The third developer conveying member 216, as shown by FIG. 3, is furnished on the upper parts of the conveyance use side wall 213 and the toner cartridge 204; and is used for conveying the toner accumulating in the opening hole 213*d* of the conveyance use side wall 213 to the toner cartridge 204. The third developer conveying member 216 has a screw SC2, on its one end, the gear g7 stated above is installed.

The other end of the third developer conveying member 216, as shown by FIG. 3, extends from the opening hole 213*d* of the conveyance use side wall 213; and is fixed on the inside wall of the toner cartridge 204 by using a bearing (not shown).

Then, when the gear g7 installed on the third developer conveying member 216 rotates on the basis of the movement of the second developer conveying member 215, the third developer conveying member 216 rotates; and takes the toner conveyed to the opening hole 213*d* of the conveyance use side wall 213 into the screw SC2 so as to convey the toner to the toner cartridge 204 in an upper position along a direction of "S".

Through the third developer conveying member 216, the toner with a high density of development remainder toner conveyed to the upside of the toner cartridge 204 drops; and is mixed with toner kept in the toner cartridge 204 by a stir of the stirring member 209. Thereby, the toner which accumulates in the bottom part of the toner accommodating room 205 and in which density of development remainder toner is high, is dispersed to toner kept in the toner cartridge 204.

Figure 6:
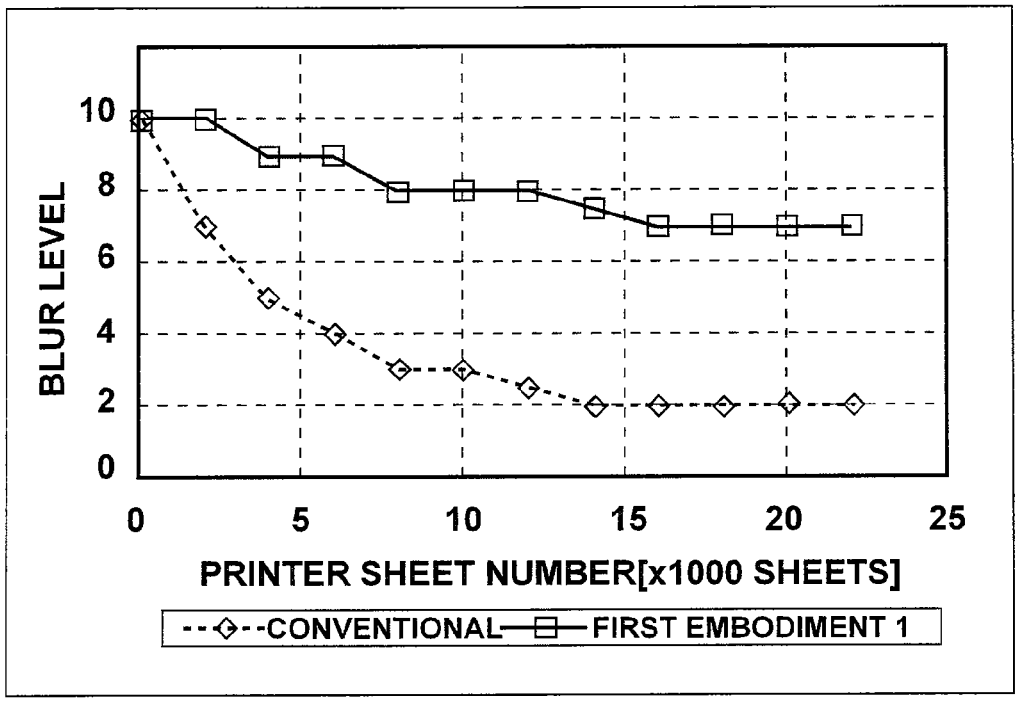
FIG. 6 is a diagram showing a change of blur level in image forming apparatus of embodiment 1 of the present invention.

Regarding a comparison of blur level between the image forming apparatus 100 in the embodiment of the present invention and the conventional image forming apparatus, its experiment result is shown by FIG. 6.

FIG. 6 is a diagram showing a change of blur level in image forming apparatus of embodiment 1 of the present invention.

The comparison is based on a ratio of blur when performing a continuous print for 22,000 sheets of A4 ordinary papers in duty of 100% (i.e. to print all over a piece of paper). Here, the duty is a ratio of toner image with respect to an effective print area (except margin) in paper, as an image ratio. Further, as blur level, level "10" represents that the ratio of blur is 0; continuously, when the ratios of blur is under 2%, and is under 4% respectively, level "9" and level "8" are evaluated.

From the experiment result shown by FIG. 6, it is clear that the image forming apparatus 100 can substantially reduce occurrence of blur in comparison with the conventional image forming apparatus.

Figure 7:
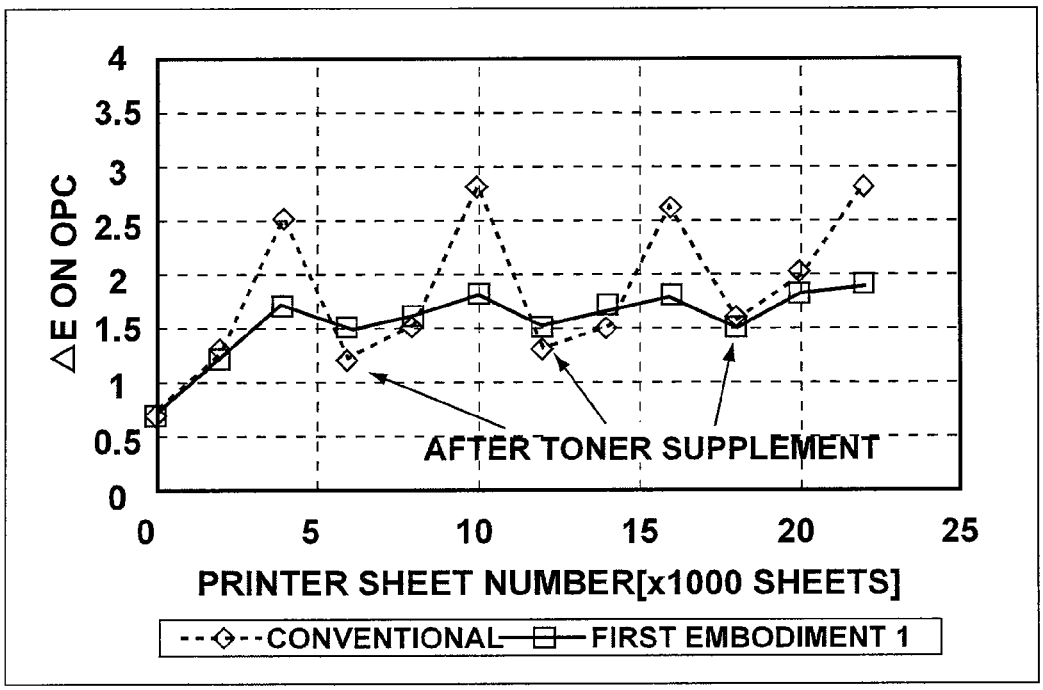
FIG. 7 is a diagram showing a change of color difference (ΔE) in image forming apparatus of embodiment 1 of the present invention.

Next, regarding a comparison of image defectiveness caused by bad charge, that is, a comparison of color difference ΔE caused by fog, between the image forming apparatus 100 in the embodiment of the present invention and the conventional image forming apparatus, its experiment result is shown by FIG. 7.

FIG. 7 is a diagram showing a change of color difference (ΔE) in image forming apparatus of embodiment 1 of the present invention.

In the comparison, print process is performed for 22,000 sheets of A4 ordinary papers in duty of 0%, whenever 2,000 sheets of paper are printed, the image forming apparatus is temporarily stopped to print, then adhesive tape (Scotch Mending tape manufactured by SUMITOMO 3M Company) is used to remove toner on the photosensitive drum 202 after developing but before transferring so as to make the toner adheres to the adhesive tape. Further, a spectroscopic color measuring device (CM2600d made by KONICA MINOLTA Company) is used to measure a color difference ΔE between a case to stick the adhesive tape having the adhering toner on paper and a case only to stick adhesive tape without any toner on paper. When value of the color difference ΔE is small, fog becomes little.

According to a standard decided by American standard bureau, an evaluation standard of color difference ΔE is set as follows. In the case that $0 \leqq \Delta E \leqq 0.5$, "trace" is set, it represents that user could faintly see the color difference; in the case that $0.5 < \Delta E \leqq 1.5$, "slight" is set, it represents that user could slightly see the color difference; in the case that $1.5 < \Delta E \leqq 3.0$, "noticeable" is set, it represents that user could noticeably see the color difference; in the case that $3.0 < \Delta E \leqq 6.0$, "appreciable" is set, it represents that user could appreciably see the color difference; in the case that $6.0 < \Delta E \leqq 12$, "much" is set, it represents that user could see the color difference much; and in the case that $\Delta E > 12$, "very much" is set, it represents that user could see the color difference very much. That is, when the color difference ΔE is under 0.5, it represents that colors are the same; and when $0.5 < \Delta E \leqq 1.5$, though color difference could be seen, it may be ignore it.

In the evaluation of the color difference ΔE in the embodiment 1, toner on the photosensitive drum 202 is taken away by using adhesive tape. Though all toner on the photosensitive drum 202 could not be transferred onto paper and transfer rate of fog toner changes according to different paper, in the present invention, the color difference ΔE always is under 0.5 according to such evaluating method. So that it is judged that there is no any problem of print quality.

From the experiment result shown by FIG. 7, it is clear that the image forming apparatus 100 can substantially reduce the color difference ΔE in comparison with the conventional image forming apparatus.

<Operation of Embodiment 1>

Next, it is to explain operation of the image forming apparatus 100 in the embodiment 1 of the present invention.

The development remainder toner that is a part of toner supplied to the surface of the developing roller 207 but is remaining on the surface of the developing roller 207 without being supplied to the surface of the photosensitive drum 202 because of the pressure of the supplying roller 206 and the developing roller 207, is removed from a contact area of the supplying roller 206 and the developing roller 207 by a pressure of the supplying roller 206; and is accommodated to the toner accommodating room 205. The accommodated development remainder toner accumulates on the bottom of the toner accommodating room 205 under positions where the supplying roller 206 and developing roller 207 are furnished.

The gear g1 installed on the other end of the first developer conveying member 214, as shown by FIG. 1, engages with the gear g4 installed on the other end of the developing roller 207 via the idle gear g2, and the first developer conveying member 214 starts to rotate on the basis of rotations of the respective rollers stated above, therefore, the toner with a high density of the development remainder toner in the bottom part of the toner accommodating room 205 is conveyed toward the opening hole 213*a* of the conveyance use side wall 213 along a direction of "N" through the screw portion SC1.

The second developer conveying member 215 is placing in the belt concave portion 213*c* of the conveyance use side wall 213 as being extended by the gear g6 installed on the other end of the metal shaft 2061 of the supplying roller 206, the gear g7 installed on the other end of the third developer conveying member 216, and the gear g8; uses the respective ditches 2151 to carry the toner conveyed to the opening hole 213*a* of the conveyance use side wall 213; and moves upward along a direction of "Q".

Then, when the ditch 2151 moves near to the gear g7 so as to move downward, the toner carried and conveyed by the ditch 2151 of the second developer conveying member 215 drops from the ditch 2151. The toner having dropped from the ditch 2151, as shown by FIG. 2, accumulates in the opening hole 213*d* of the conveyance use side wall 213.

When the gear g7 installed on the third developer conveying member 216 rotates on the basis of the movement of the second developer conveying member 215, the third developer conveying member 216 rotates; and takes the toner conveyed to the opening hole 213*d* of the conveyance use side wall 213 into the screw SC2 so as to convey the toner to the toner cartridge 204 in an upper position along a direction of "S".

Through the third developer conveying member 216, the toner with a high density of development remainder toner conveyed to the upside of the toner cartridge 204 drops; and is mixed with toner kept in the toner cartridge 204 by a stir of the stirring member 209. Thereby, the toner which accumulates in the bottom part of the toner accommodating room 205 and in which density of development remainder toner is high, is dispersed to toner kept in the toner cartridge 204.

With respect to the embodiment 1 of the present invention, in conventional image forming unit, because the development remainder toner or toner unused in image formation remains in bottom of the toner accommodating room, and the supplying roller is furnished near to the bottom, so the supplying roller supplies toner in which density of the development remainder toner is high. The development remainder toner gets repeatedly the pressure of the supplying roller and the developing roller, so external additive agent of the development remainder toner exfoliates, so that charging characteristic decided by characteristic of the external additive agent drops. Thus, the development remainder toner does not evenly adhere to the surface of the supplying roller, so it is impossible to form an even toner layer on the developing roller. Further, such toner whose external additive agent has exfoliated, only has a low fluidity, therefore, such toner adhering physically to respective rollers difficulty come off.

Thereby, in the image forming apparatus having such image forming unit, because it is to use toner in which the density of the degrading development remainder toner is high to perform a developing process, some toner is transferred onto white ground part of paper, which originally should not be printed. Thus, the white ground becomes dirty and looks like gray, so a phenomenon such as "fog" occurred. Therefore, there is a problem that it is impossible to get toner image with good quality.

However, in comparison to the conventional image forming apparatus, the embodiment 1 of the present invention can obtain the following effect.

<Effect of Embodiment 1>

According to the image forming apparatus 100 of the embodiment 1 of the present invention, the first developer conveying member 214 conveys the toner with a high density of the development remainder toner accumulating in the bottom part of the toner accommodating room 205 to the opening hole 213*a* of the conveyance use side wall 213; the second developer conveying member 215 conveys the toner accumulating in the opening hole 213*a* to the opening hole 213*d* on the upside of the conveyance use side wall 213; the third developer conveying member 216 conveys the toner accumulating in the opening hole 213*d* to the upper part of the toner cartridge 204 so as to drop the toner to toner kept in the toner cartridge 204; and the stirring member 209 stirs the dropped toner into toner kept in the toner cartridge 204. Therefore, the development remainder toner does not accumulate in the bottom part of the toner accommodating room 205, but is dispersed to toner kept in the toner cartridge 204. As a result, it is possible to perform a print process with high quality. Further, according to the image forming apparatus 100, it is possible to prevent toner unused in developing process from accumulating in the bottom part of the toner accommodating room 205.

Embodiment 2

<Structure of Embodiment 2>

In the following description, regarding the same components, operation and effect as that in embodiment 1, their explanation is omitted.

Figure 8:
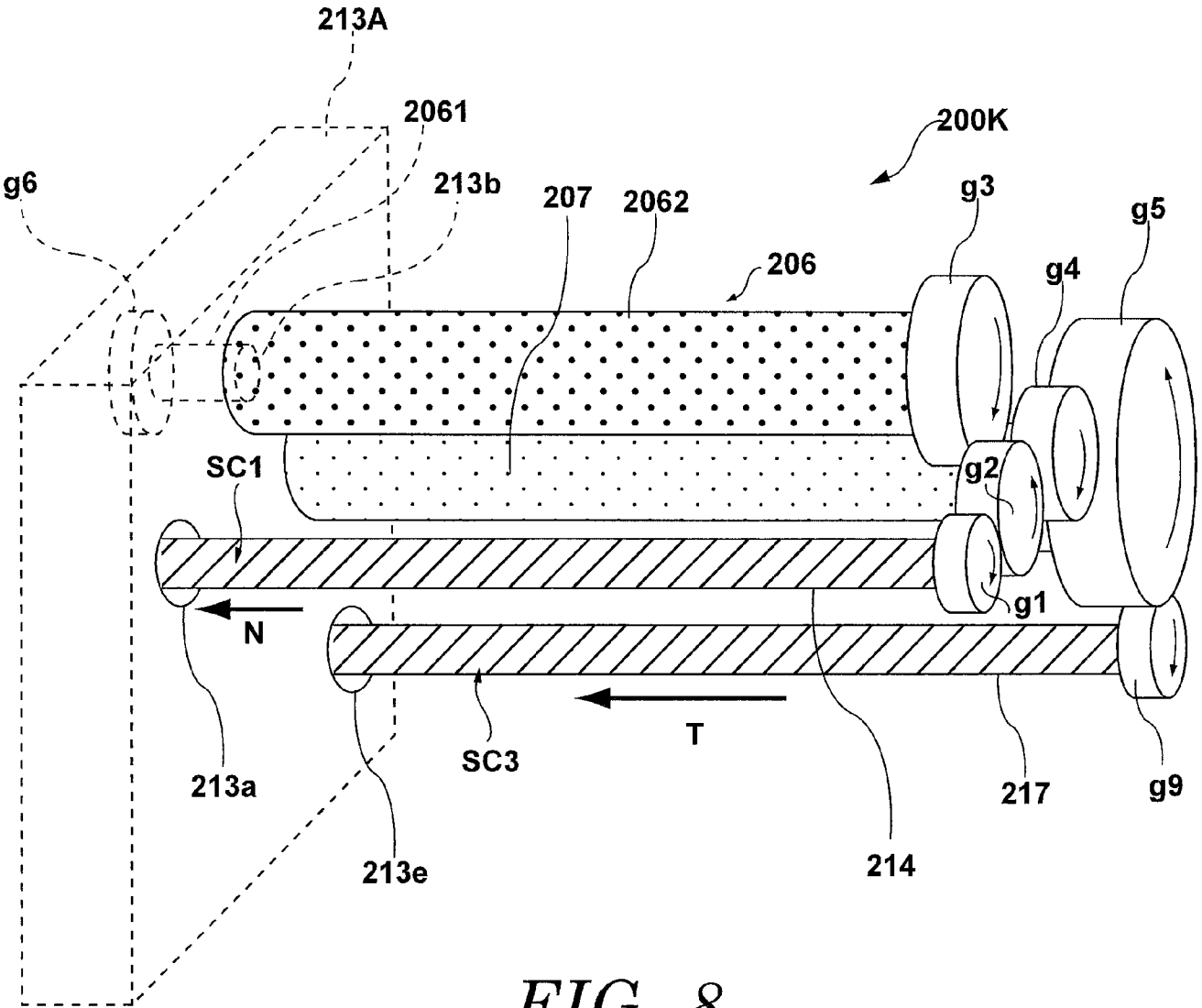
FIG. 8 is a first cubic diagram showing a structure of image forming unit in embodiment 2 of the present invention.
Figure 9:
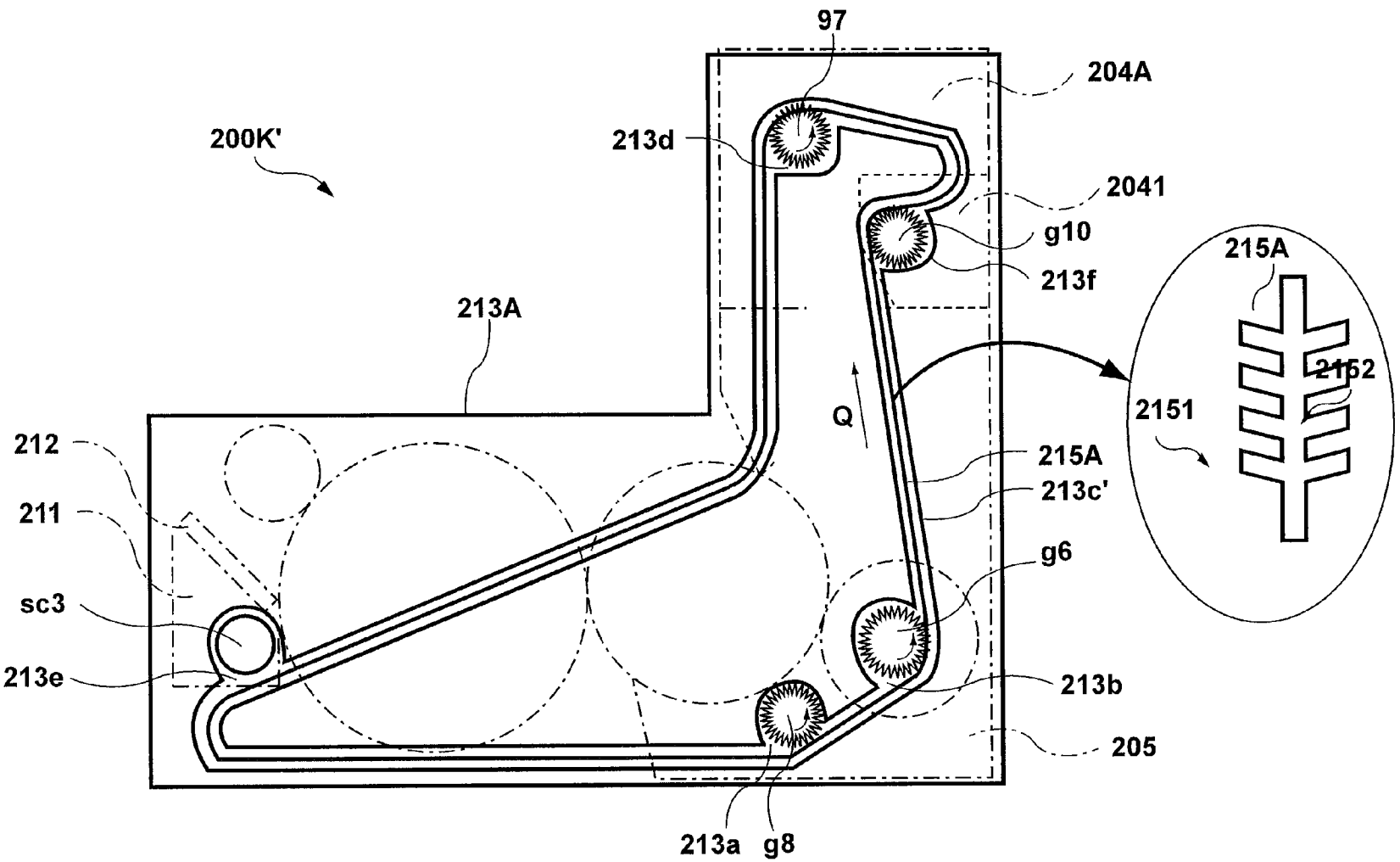
FIG. 9 is a first diagram showing a structure of image forming unit in embodiment 2 of the present invention.
Figure 10:
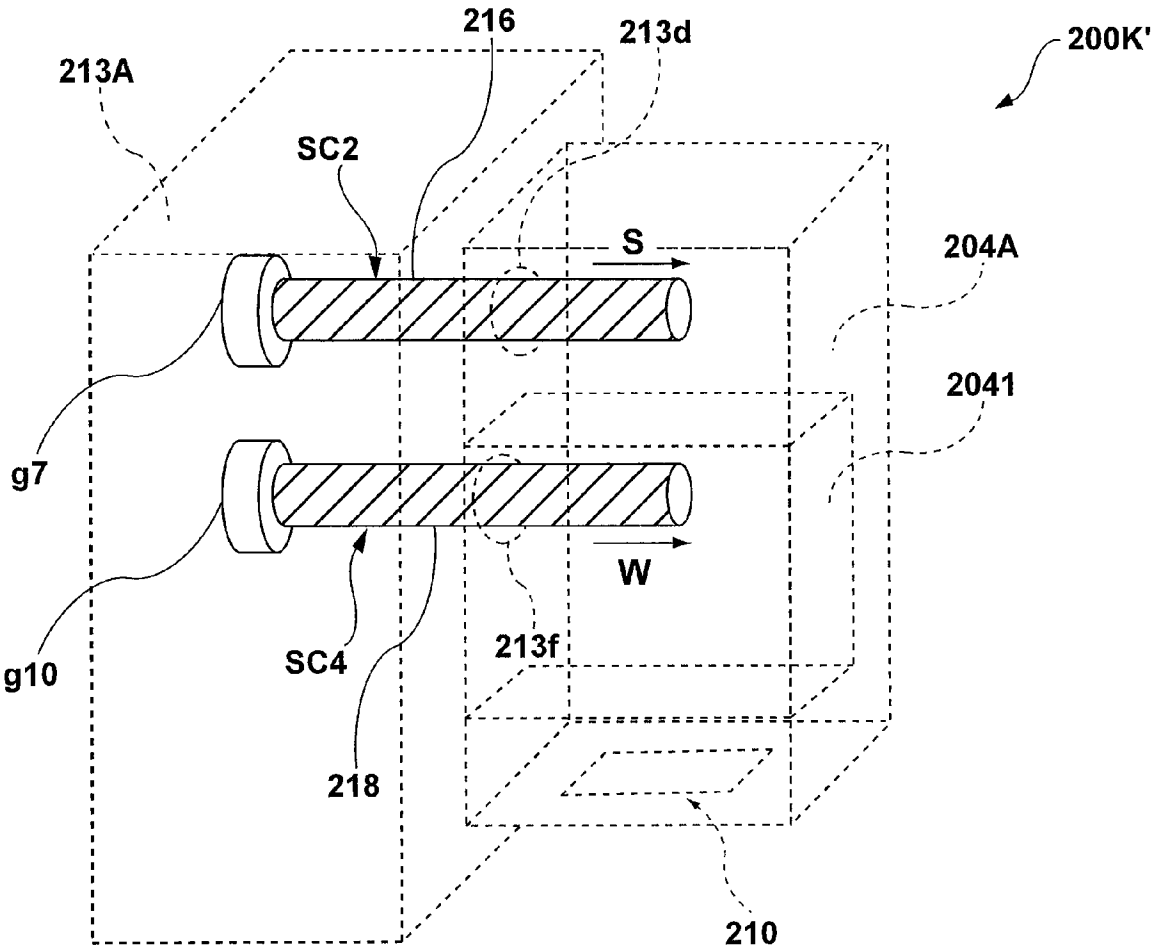
FIG. 10 is a second cubic diagram showing a structure of image forming unit in embodiment 2 of the present invention.
Figure 11:
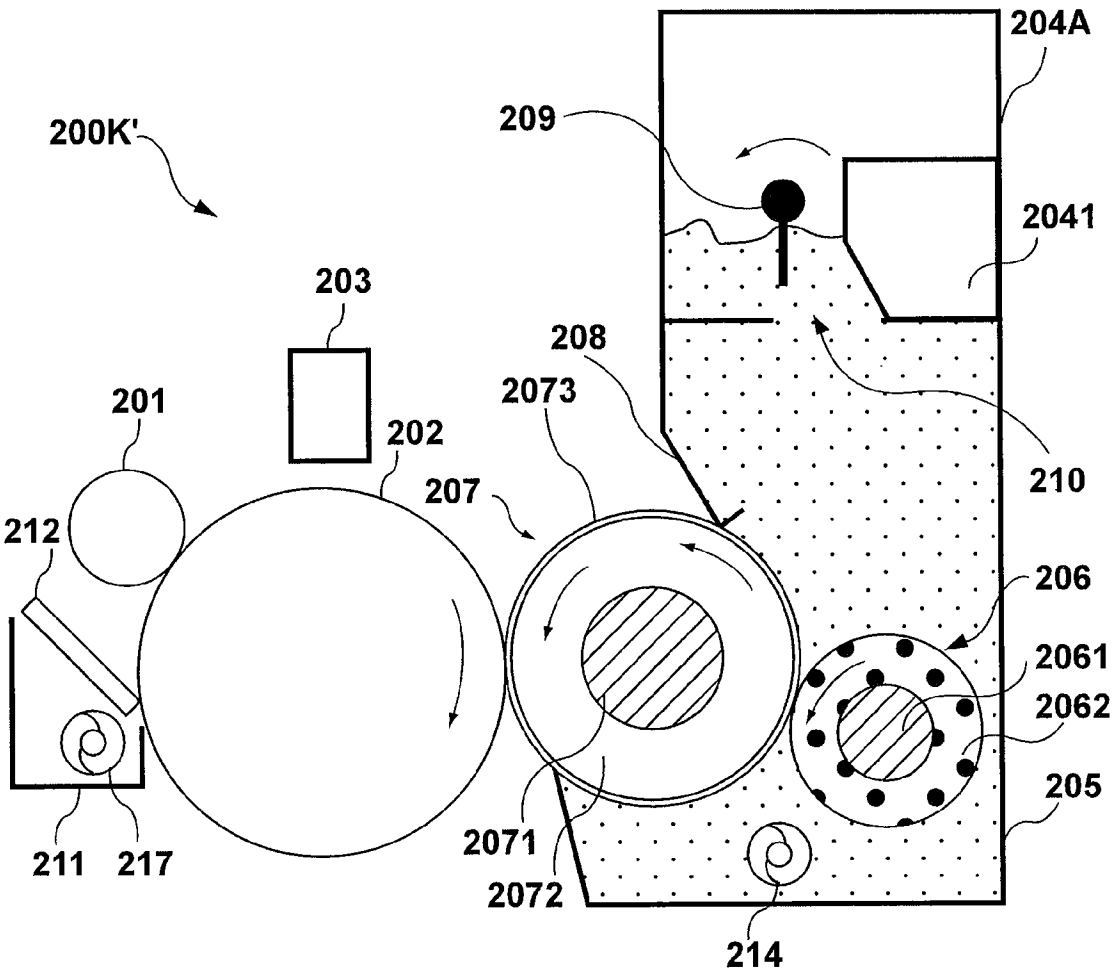
FIG. 11 is a second diagram showing a structure of image forming unit in embodiment 2 of the present invention.

FIG. 8 is a first cubic diagram showing a structure of image forming unit in embodiment 2 of the present invention; FIG. 9 is a first diagram showing a structure of image forming unit in embodiment 2 of the present invention; FIG. 10 is a second cubic diagram showing a structure of image forming unit in embodiment 2 of the present invention; and FIG. 11 is a second diagram showing a structure of image forming unit in embodiment 2 of the present invention.

In the embodiment 2 of the present invention, an image forming unit 200K', as shown by FIG. 9, uses a second developer conveying member 215A for conveying the transfer remainder toner kept in the transfer remainder toner accommodating section 211 to the a waste toner accommodating room 2041 in toner cartridge 204A. Then, in the image forming unit 200K', in order to convey the transfer remainder toner kept in the transfer remainder toner accommodating section 211 to the a waste toner accommodating room 2041 in toner cartridge 204A, a fourth developer conveying member 217 shown by FIG. 8 and a fifth developer conveying member 218 shown by FIG. 10 are used.

The following is to explain main part of the embodiment 2 of the present invention in detail.

The image forming unit 200K' includes a conveyance use side wall 213A (refer to FIG. 8) and a second developer conveying member 215A (refer to FIG. 9) to replace the conveyance use side wall 213 and the second developer conveying member 215 in the image forming unit 200K of the embodiment 1; and includes the fourth developer conveying member 217 (refer to FIG. 8) and the fifth developer conveying member 218 (refer to FIG. 10).

On the conveyance use side wall 213A, as shown by FIG. 9, there is a belt concave portion 213*c*' to replace the belt concave portion 213*c* in the image forming unit 200K of the embodiment 1; as shown by FIG. 8, there is an opening hole 213*e* used for letting one end of the fourth developer conveying member 217 pass through; as shown by FIG. 10, there is an opening hole 213*f* used for letting one end of the fifth developer conveying member 218 pass through. In the conveyance use side wall 213A, as shown by FIG. 9, an opening hole 213*a*, an opening hole 213*b*, the belt concave portion 213*c*', an opening hole 213*d*, the opening hole 213*e* and the opening hole 213*f* are coupled.

The fourth developer conveying member 217, as shown by FIG. 11, is furnished on the bottom part of the transfer remainder toner accommodating section 211; and is used for conveying transfer remainder toner kept in the transfer remainder toner accommodating section 211 to the opening hole 213*e* manufactured on the conveyance use side wall 213A. The fourth developer conveying member 217 has a screw portion SC3. When the fourth developer conveying member 217 rotates according to a structure described below, the transfer remainder toner is conveyed to the opening hole 213*e* of the conveyance use side wall 213A.

On other end of the fourth developer conveying member 217, as shown by FIG. 8, a gear g9 is furnished as rotation transfer member; and engages with the gear g5 furnished on other end of the photosensitive drum 202. Because the gear g5 is driven by a driving motor (not shown), the fourth developer conveying member 217 starts to rotate on the basis of rotation of the photosensitive drum 202 so as to convey the transfer remainder toner kept in the transfer remainder toner accommodating section 211 along a direction of "T" shown by FIG. 8, through the screw portion SC3. As shown by FIG. 8, because the one end of the fourth developer conveying member 217 is inserted into the opening hole 213*e* manufactured on the conveyance use side wall 213A, the transfer remainder toner is conveyed to the opening hole 213*e*.

The second developer conveying member 215A, as shown by FIG. 9, is an endless belt. Not only the second developer conveying member 215A is used for conveying the toner in the opening hole 213*a* locating on the underside of the conveyance use side wall 213A toward the opening hole 213*d* locating on the upside of the conveyance use side wall 213A as well as the second developer conveying member 215 in the image forming unit 200K; but also the second developer conveying member 215A is used for conveying the transfer remainder toner that has been conveyed to the opening hole 213*e* toward the opening hole 213*f* locating on the upside. The second developer conveying member 215A is furnished inside the belt concave portion 213*c*'. The second developer conveying member 215A, as shown by FIG. 9, has plural ditches 2151 that are formed on the inside of the endless belt, and has plural ditches 2152 that are formed on the outside of the endless belt. The ditch 2151 and the ditch 2152 engage with respective gears described below and are used for carrying the toner, respectively.

Then, the second developer conveying member 215A, as shown by FIG. 9, is furnished in the belt concave portion 213*c*' as being extended by gear g6, gear g7, gear g8 and a gear 10 that are used to transfer rotation drive.

One end of the fourth developer conveying member 217, as shown by FIG. 9, is facing to the second developer conveying member 215, the screw portion SC3 is formed till a position facing to the second developer conveying member 215. Thereby, the transfer remainder toner taken in the screw portion SC3 of the fourth developer conveying member 217 is conveyed toward the opening hole 213*e* and drops to the opening hole 213*e*.

The gear g10, as shown by FIG. 9, is furnished on the one end of the fifth developer conveying member 218; and engages with the plural ditches 2152 of the second developer conveying member 215A.

According to the above stated structure, the second developer conveying member 215A, as shown by FIG. 9, uses the respective ditches 2152 to carry the transfer remainder toner conveyed to the opening hole 213*e* of the conveyance use side wall 213A and moves upward along a direction of "Q", on the basis of the rotation of the supplying roller 206.

Then, when the ditch 2152 moves near to the gear g10 so as to move downward, the transfer remainder toner carried and conveyed by the ditch 2152 of the second developer conveying member 215A drops from the ditch 2152. The transfer remainder toner having dropped from the ditch 2152, as shown by FIG. 9, accumulates in the opening hole 213*f* of the conveyance use side wall 213A.

The fifth developer conveying member 218, as shown by FIG. 10, is furnished on the upper parts of the waste toner accommodating room 2041 in the toner cartridge 204A; and is used for conveying the transfer remainder toner accumulating in the opening hole 213*f* of the conveyance use side wall 213A to the waste toner accommodating room 2041. The fifth developer conveying member 218 has a screw SC4, on its one end, the gear g10 stated above is installed.

The other end of the fifth developer conveying member 218, as shown by FIG. 10, extends from the opening hole 213*f* of the conveyance use side wall 213A; and is fixed on the inside wall of the waste toner accommodating room 2041 by using a bearing (not shown).

Then, when the gear g10 installed on the fifth developer conveying member 218 rotates on the basis of the movement of the second developer conveying member 215A, the fifth developer conveying member 218 rotates; and takes the transfer remainder toner conveyed to the opening hole 213*f* of the conveyance use side wall 213A into the screw SC4 so as to convey the transfer remainder toner to the waste toner accommodating room 2041 in the toner cartridge 204A in an upper position along a direction of "W".

Through the fifth developer conveying member 218, the transfer remainder toner conveyed to the upside of the waste toner accommodating room 2041 in the toner cartridge 204A drops; and is collected in the waste toner accommodating room 2041 as waste toner. Then, the waste toner accommodated in the waste toner accommodating room 2041 in the toner cartridge 204A is withdrawn together with the toner cartridge 204A when exchanging the toner cartridge 204A. Here, in the case that image forming unit is the image forming unit 200K', it is possible to collect the transfer remainder toner of black color conveyed from the transfer remainder toner accommodating section 211 to the toner cartridge 204A, but not to the waste toner accommodating room 2041; and uses the collected transfer remainder toner again for developing process.

Moreover, regarding other components in the image forming unit 200K', they are the same as that in the image forming unit 200K of the embodiment 1. Further, regarding other image forming units of other colors of yellow, magenta, cyan, they have the same structure as the image forming unit 200K'.

<Operation of Embodiment 2>

Next, it is to explain operation of the image forming unit 200K' in the embodiment 2 of the present invention. Regarding operation to prevent the development remainder toner from accumulating in the bottom part of the toner accommodating room 205 in the image forming unit 200K', it has been explained in embodiment 1. Here, it is only to explain operation to convey the transfer remainder toner collected in the transfer remainder toner accommodating section 211 to the waste toner accommodating room 2041 in the toner cartridge 204A in detail.

The transfer remainder toner that is remaining on the surface of the photosensitive drum 202 and is unused in the developing process, as shown by FIG. 11, is removed by the cleaning blade 212 and is collected in the transfer remainder toner accommodating section 211.

The gear g9 installed on the other end of the fourth developer conveying member 217, as shown by FIG. 8, engages with the gear g5 installed on the other end of the photosensitive drum 202, and the fourth developer conveying member 217 starts to rotate on the basis of rotation of the photosensitive drum 202, the transfer remainder toner kept in the transfer remainder toner accommodating section 211 is conveyed toward the opening hole 213*e* of the conveyance use side wall 213A along a direction of "T" through the screw portion SC3.

The second developer conveying member 215A is placing in the belt concave portion 213*c*' of the conveyance use side wall 213A as being extended by the gear g6 installed on the other end of the metal shaft 2061 of the supplying roller 206, the gear 8, the gear g7 and gear g10; uses the respective ditches 2152 to carry the transfer remainder toner conveyed to the opening hole 213*e* of the conveyance use side wall 213A; and moves upward along a direction of "Q".

Then, when the ditch 2152 moves near to the gear g10 so as to move downward, the transfer remainder toner carried and conveyed by the ditch 2152 of the second developer conveying member 215A drops from the ditch 2152, as shown by FIG. 9. The transfer remainder toner having dropped from the ditch 2152 accumulates in the opening hole 213*f* of the conveyance use side wall 213A.

When the gear g10 installed on the one end of the fifth developer conveying member 218 rotates on the basis of the movement of the second developer conveying member 215A, the fifth developer conveying member 218 rotates; and as shown by FIG. 10, takes the transfer remainder toner accumulating in the opening hole 213*f* of the conveyance use side wall 213A into the screw SC4 so as to convey the transfer remainder toner to the waste toner accommodating room 2041 in the toner cartridge 204A in an upper position along a direction of "W".

Through the fifth developer conveying member 218, the transfer remainder toner that has been conveyed to the upside of the waste toner accommodating room 2041 in the toner cartridge 204A drops; and is collected to the waste toner accommodating room 2041 as waste toner. The waste toner kept in the waste toner accommodating room 2041 of the toner cartridge 204A is withdrawn together with the toner cartridge 204A when exchanging the toner cartridge 204A.

<Effect of Embodiment 2>

According to the image forming unit 200K' of the embodiment 2 of the present invention, with using the second developer conveying member 215A to convey the toner with a high density of the development remainder toner accumulating in the bottom part of the toner accommodating room 205 to the upside of the toner cartridge 204A, the transfer remainder toner collected in the transfer remainder toner accommodating section 211 is also conveyed to the waste toner accommodating room 2041 in the toner cartridge 204A. Therefore, not only it is possible to disperse the toner with a high density of development remainder toner to be used again to toner kept in the toner cartridge 204A; but also it is possible to collect the transfer remainder toner to be withdrawn to the waste toner accommodating room 2041. As a result, in comparison with the image forming unit 200K in embodiment 1, it is possible to simplify a structure of developer conveying mechanism.

THE UTILIZATION POSSIBILITY IN INDUSTRY

In the above stated explanation, only such case is explained that the present invention is applied to a color electronic printer of four colors. However, the present invention is not limited in this case. The present invention also can be applied to various devices such as monochrome printer, copying apparatus, facsimile apparatus, multiplex apparatus having two functions or over and the like. If only LED head and image forming unit exist, the present invention can be applied.

The present invention is not limited to the foregoing embodiments but many modifications and variations are possible within the spirit and scope of the appended claims of the invention.

What is claimed is:

1. An image forming unit, comprising:

a developer accommodating section that accommodates developer;

a developing member that has a rotation axis for rotating in the developer accommodating section, the developing member supplying developer to an electrostatic latent image on an image carrying body;

a supplying member that faces to the developing member and supplies developer to the developing member; and a conveying mechanism that conveys developer in a bottom part of the developer accommodating section to an upper part of the developer accommodating section;

wherein the conveying mechanism includes:

a first conveying member that is furnished between the bottom part of the developer accommodating section and the developing and supplying members, the first conveying member conveying developer to an extending direction of the rotation axis and discharging the developer out of the developer accommodating section through a side wall of the developer accommodating section;

a second conveying member that is furnished along the side wall of the developer accommodating section and conveys the developer discharged out of the developer accommodating section by the first conveying member to the upper part of the developer accommodating section; and a third conveying member that is furnished on the upper part of the developer accommodating section and conveys the developer conveyed by the second conveying member to the inside of the developer accommodating section.

2. The image forming unit according to claim 1, wherein the first conveying member has a screw portion.

3. The image forming unit according to claim 1, wherein the second conveying member is a belt shape member whose side surface has plural ditches.

4. The image forming unit according to claim 1, wherein the third conveying member has a screw portion.

5. The image forming unit according to claim 1, further comprising:

a cleaning member that is used for removing remainder developer that is unused in developing process and is remaining on the image carrying body after transfer; and a collecting section that collects the remainder developer removed by the cleaning member, wherein the developer accommodating section has a collecting room for collecting the remainder developer collected by the collecting section as waste developer; and the conveying mechanism conveys the remainder developer collected in the collecting section to the collecting room.

6. The image forming unit according to claim 5, wherein the conveying mechanism further includes:

a fourth conveying member that is furnished in the collecting section and conveys the remainder developer in the collecting section out of the collecting section; and a fifth conveying member that is furnished on the upper part of the collecting room and conveys the remainder developer conveyed by the fourth conveying member to the inside of the collecting room, and wherein the second conveying member conveys the remainder developer conveyed out of the collecting section by the fourth conveying member to the fifth conveying member.

7. The image forming unit according to claim 6, wherein the first conveying member, the third conveying member, the fourth conveying member and the fifth conveying member respectively has a screw portion, with respective rotations of the respective screw portions, the developer and the remainder developer are conveyed.

8. The image forming unit according to claim 6, wherein the second conveying member is formed from a belt member whose two sides respectively have plural ditches, with rotation of the belt member, the developer is carried and conveyed by the ditch on one of the two sides, and the remainder developer is carried and conveyed by the ditch on other of the two sides.

9. An image forming apparatus, comprising:

at least one image forming unit, wherein the image forming unit includes:

a developer accommodating section that accommodates developer a developing member that has a rotation axis for rotating in the developer accommodating section, the developing member supplying developer to an electrostatic latent image on an image carrying body;

a supplying member that faces to the developing member and supplies developer to the developing member; and a conveying mechanism that conveys developer in a bottom part of the developer accommodating section to an upper part of the developer accommodating section, wherein the conveying mechanism includes:

a first conveying member that is furnished between the bottom part of the developer accommodating section and the developing and supplying members, the first conveying member conveying developer to an extending direction of the rotation axis and discharging the developer out of the developer accommodating section through a side wall of the developer accommodating section;

a second conveying member that is furnished along the side wall of the developer accommodating section and conveys the developer discharged out of the developer accommodating section by the first conveying member to the upper part of the developer accommodating section; and a third conveying member that is furnished on the upper part of the developer accommodating section and conveys the developer conveyed by the second conveying member to the inside of the developer accommodating section.

* * * * *